US011988391B2

(12) United States Patent
Acosta Herrero et al.

(10) Patent No.: US 11,988,391 B2
(45) Date of Patent: May 21, 2024

(54) PAN SUPPORT, GAS HOB AND METHOD FOR PRODUCING A PAN SUPPORT

(71) Applicant: BSH Hausgeräte GmbH, Munich (DE)

(72) Inventors: Luis Acosta Herrero, Maliaño (ES); Roberto Carballo Fernandez, Santander (ES); Alberto Lopez Ortiz, Santander (ES); Luis Antonio Palacios Valdueza, Astillero (ES); Emilio Placer Maruri, Liencres (ES)

(73) Assignee: BSH Hausgeräte GmbH, Munich (DE)

( * ) Notice: Subject to any disclaimer, the term of this patent is extended or adjusted under 35 U.S.C. 154(b) by 1124 days.

(21) Appl. No.: 16/641,264

(22) PCT Filed: Aug. 24, 2018

(86) PCT No.: PCT/IB2018/056424
§ 371 (c)(1),
(2) Date: Feb. 24, 2020

(87) PCT Pub. No.: WO2019/048970
PCT Pub. Date: Mar. 14, 2019

(65) Prior Publication Data

US 2023/0314006 A1 Oct. 5, 2023

(30) Foreign Application Priority Data

Sep. 5, 2017 (ES) ..... ES201731072

(51) Int. Cl.

| | |
|---|---|
| ***F24C 15/10*** | (2006.01) |
| ***F23D 14/06*** | (2006.01) |
| ***F23D 14/10*** | (2006.01) |
| ***F24C 3/08*** | (2006.01) |

(52) U.S. Cl.
CPC ..... *F24C 15/107* (2013.01); *F23D 14/06* (2013.01); *F23D 14/10* (2013.01); *F24C 3/085* (2013.01); *F23D 2900/14041* (2013.01)

(58) Field of Classification Search
CPC ..... F23D 14/10; F23D 14/06; F23D 2900/14041; F24C 15/107; F24C 3/085
See application file for complete search history.

(56) References Cited

U.S. PATENT DOCUMENTS

| | | | |
|---|---|---|---|
| 6,148,811 | A | 11/2000 | Miller |
| 6,299,436 | B1 | 10/2001 | Huang |
| 2010/0126496 | A1 | 5/2010 | Luo et al. |
| 2014/0076302 | A1 | 3/2014 | Adkins |

(Continued)

FOREIGN PATENT DOCUMENTS

| | | | |
|---|---|---|---|
| CN | 2731314 | Y | 10/2005 |
| CN | 103471147 | A | 12/2013 |

(Continued)

OTHER PUBLICATIONS

Report of Examination EP18772889.4 dated Jun. 30, 2021.

(Continued)

*Primary Examiner* — Alfred Basichas
(74) *Attorney, Agent, or Firm* — Michael E. Tschupp; Andre Pallapies; Brandon G. Braun

(57) ABSTRACT

A pan support for a gas cooker includes a support structure for a container for food to be cooked. The support structure of the pan support has a contact surface for the container and a channel for a flammable combustion gas and air mixture, which channel leads to gas outlet openings.

20 Claims, 6 Drawing Sheets

(56) References Cited

U.S. PATENT DOCUMENTS

| | | | |
|---|---|---|---|
| 2016/0201902 | A1 | 7/2016 | Cadima |
| 2017/0205075 | A1 | 7/2017 | Cadima |

FOREIGN PATENT DOCUMENTS

| | | | |
|---|---|---|---|
| CN | 106224958 | A | 12/2016 |
| GB | 2240168 | A | 7/1991 |
| WO | 2015115860 | A1 | 8/2015 |

OTHER PUBLICATIONS

National Search Report CN201880057426.7 dated May 21, 2021.
National Search Report ES 201731072 dated Oct. 16, 2018.
International Search Report PCT/IB2018/056424 dated Nov. 7, 2018.

PAN SUPPORT, GAS HOB AND METHOD FOR PRODUCING A PAN SUPPORT

CROSS-REFERENCES TO RELATED APPLICATIONS

This application is the U.S. National Stage of International Application No. PCT/IB2018/056424, filed Aug. 24, 2018, which designated the United States and has been published as International Publication No. WO 2019/048970 A1 and which claims the priority of Spanish Patent Application, Serial No. P201731072, filed Sep. 5, 2017, pursuant to 35 U.S.C. 119(a)-(d).

BACKGROUND OF THE INVENTION

The present invention relates to a pan support, a gas hotplate with such a pan support, and a gas cooker with such a gas hotplate and/or such a pan support. The invention further relates to a method for producing a pan support.

Gas hotplates generally comprise a cooktop plate with a through-hole, on which a gas burner is arranged. The gas burner has a gas valve for providing combustion gas, wherein the gas valve is generally arranged below the cooktop plate. Here, the combustion gas must be mixed with primary air to form a flammable combustion gas and air mixture. This generally takes place in a mixing chamber, which is arranged below the cooktop plate.

A gas hotplate can also comprise a pan support. Here, the pan support can be provided as a removable component in order to make the gas hotplate easier to clean, for example. The pan support is generally just a support structure, which is configured to hold a container for food to be cooked above the gas burner.

The gas burner usually comprises a burner upper part, which is arranged above the cooktop plate and has gas burner openings. The combustion gas and air mixture is provided at the gas burner openings in order to maintain a flame below the container for food to be cooked for the purpose of heating the same. The burner upper part and the pan support are embodied as separate components.

BRIEF SUMMARY OF THE INVENTION

Against this background, an object of the present invention consists in providing an improved pan support.

Accordingly, a pan support for a gas cooker is proposed, with a support structure for a container for food to be cooked, which has a contact surface for the container for food to be cooked and a channel for a flammable combustion gas and air mixture, which channel leads to gas outlet openings.

The "contact surface" means for example a contact surface for pans. "Channel" means in particular a cavity which is surrounded along its extent by a solid material of the support structure and is configured to guide a fluid, in particular a combustion gas and air mixture, along its extent. For this reason, the channel is for example substantially gas-tight when all channel openings are closed. The channel can for example be divided at least in sections into several channel branches. The support structure comprises the gas outlet openings for providing a combustion gas and air mixture. The gas outlet openings are embodied for example as gas burner openings. The pan support is configured to provide a flame at the gas outlet openings for heating the container for food to be cooked.

A functional integration can be achieved by the gas outlet openings being embodied on the support structure, since the support structure supports the container for food to be cooked and can simultaneously provide the combustion gas and air mixture for generating and/or maintaining the flame. An additional gas burner cover or a burner upper part with gas outlet openings is not required, for example. Furthermore, an individual and high-quality design of the pan support, a gas hotplate and a gas cooker can be provided. A gas hotplate equipped with the pan support is also easier to clean.

According to one embodiment, the support structure is embodied in one piece or from a single piece of material.

This produces the advantage that the pan support is easy to handle, particularly when removing the pan support from a cooktop plate. "From a single piece of material" means that the pan support is manufactured, in particular cast, from one base material/raw material. For example, the pan support is manufactured by means of 3D printing. With a pan support manufactured from a single piece of material, complex joining steps can be dispensed with during manufacture. Moreover, a high-quality visual design of the pan support can be provided.

According to a further embodiment, the pan support comprises a pipe section for mixing primary air and combustion gas to form the flammable combustion gas and air mixture, wherein the support structure and the pipe section are embodied in particular in one piece or from a single piece of material.

In further embodiments, the pan support can be joined together from several parts. The channel can then be provided in just one part, which facilitates sealing.

For example, the pipe section can be designated as part of a venturi nozzle, venturi nozzle section and/or mixing chamber. Advantageously, in this way a pan support, a gas burner cover/burner upper part and a nozzle arrangement for forming a combustion gas mixture, such as a venturi nozzle, can be provided in one component. For example, primary air, which is mixed with combustion gas, is provided at an opening of the pipe section. In particular, the pipe section comprises a channel section. The pipe section extends for example in a vertical direction. A length of the pipe section is preferably greater than a distance between the contact surface and a support surface of the pan support on a cooktop plate.

According to a further embodiment, the support structure has at least two fingers, in particular precisely three, four, five or six fingers, which are arranged in particular radially about a central axis of the pan support.

A "central axis" can be understood to mean an axis that extends parallel to the vertical direction. Viewed from above, the central axis pierces through a radial center point, to which or at which the fingers point. For example, the fingers comprise a radial section, which extends in a radial direction running perpendicular to the vertical direction. Viewed in the cross-section, the radial section is embodied for example as a T-profile in order to enlarge the contact surface. The pipe section is for example arranged about the central axis so that the central axis embodies the longitudinal axis of the pipe section. For example, the fingers protrude away from the pipe section. In particular, the fingers comprise a support surface, which is configured to rest on a top side of the cooktop plate. For this reason, the fingers are configured in particular to be supported on a cooktop plate. Alternatively, the fingers can be attached to a base frame, which is supported on the cooktop plate and runs around the pipe section.

In embodiments, the fingers merge at the pipe section.

According to a further embodiment, the fingers are embodied to be L-shaped.

For example, a respective finger extends from the support surface initially in the vertical direction to form a column section, bends, and then extends in the radial direction R to form the radial section toward the central axis. A stable state of the pan support on the cooktop plate can thus be ensured. In embodiments, the pan support stands on a surface of a cooktop plate on the fingers, and the pipe section extends through an opening in the cooktop plate to below the cooktop plate, where it admits the combustion gas and air mixture into the channel.

According to a further embodiment, at least one of the fingers has the gas outlet openings.

The channel comprises for example channel branches, which are embodied in the fingers. The channel section arranged within the pipe section preferably splits into the channel branches, so that a fluid connection is embodied between the channel section and the channel branches.

According to a further embodiment, the gas outlet openings are arranged adjacent to one another along a direction of extension of the at least one finger.

Advantageously, a particular visual design of the pan support can be provided. Furthermore, heat can be transmitted evenly and over a large area to an underside of the container for food to be cooked. The gas outlet openings provided on one of the fingers are preferably provided at an equal height and spaced at an equal distance from one another.

According to a further embodiment, the gas outlet openings are open to one side of the finger.

For example, the gas outlet openings are embodied on a lateral surface or lateral wall of the radial section.

According to a further embodiment, at least one part of the gas outlet openings are open to the top.

The part of the gas outlet openings open to the top is embodied for example on a wall, which delimits the pipe section to the top and has a main extension plane that runs perpendicular to the vertical direction. Gas is therefore emitted directly upward on the least one part of the gas outlet openings. In particular, gas outlet openings embodied on the fingers and open to the side are also present.

According to a further embodiment, the at least one part of the gas outlet openings is formed between at least two contact surfaces for the container for food to be cooked, which are formed from different fingers, one of which is the contact surface.

The gas outlet openings open to the top are therefore arranged between the contact surfaces so that a flame can be provided centrally on the underside of the cookware.

A gas hotplate with a pan support as described above is also proposed.

According to one embodiment, the gas hotplate has a cooktop plate with at least one opening and a gas nozzle arranged below the cooktop plate for providing combustion gas, wherein a channel of the pan support extends at least partially through the at least one opening or has a fluid connection therewith, and wherein the channel is configured to guide a combustion gas and air mixture, comprising primary air and combustion gas, to the gas outlet openings.

The pan support is provided on the cooktop plate in particular in a removable manner. Because for example when the pan support is removed a top side of the cooktop plate is smooth and no protrusion, in particular a burner lid, is provided above the cooktop plate, the cooktop plate is easier to clean. The gas nozzle can for example project into the channel.

According to a further embodiment, the gas hotplate has a pipe section for mixing primary air and combustion gas to form a flammable combustion gas and air mixture, which pipe section is embodied in particular in one piece or from a single piece of material with a support structure of the pan support, wherein the pipe section pierces through the cooktop plate in a downward direction.

A lower opening of the pipe section, which is open to the bottom, is for example arranged directly above the gas nozzle. In this way, combustion gas can flow easily from the gas nozzle into the channel. This ensures that the combustion gas and air mixture can flow to the gas outlet openings. The pipe section extends through the opening of the cooktop plate and projects from an underside of the cooktop plate, for example.

This has the advantage that the pan support is connected in the radial direction to the cooktop plate in a form-fit manner. Furthermore, positioning aids can be provided on the pan support, in particular downwardly projecting protrusions, in particular pipe sections, which engage into openings of the cooktop plate in order to prevent rotation. Here, a single protrusion is sufficient to ensure that rotation is prevented. This makes it easier to attach the pan support to the cooktop plate. Alternatively, the lower opening of the pipe section can be open to one side of the pipe section and can have a fluid connection with a gas supply line extending in the radial direction.

According to a further embodiment, the support structure of the pan support has two, three, four, five or six fingers, which each comprise a contact surface for a container for food to be cooked and are supported on the cooktop plate.

The pan support is preferably supported on a top side of the cooktop plate. For example, the fingers are connected to the pipe section by being made from a single piece of material therewith.

In addition, a household appliance, in particular a gas cooker with a pan support as described above and/or a gas hotplate as described above, is proposed.

A method for operating a gas hotplate is also proposed, in which a combustion gas and air mixture is guided through a channel integrated in a pan support to gas outlet openings. The pan support is designed in particular as described above and in the following.

Furthermore, a method for producing a pan support is proposed, in particular as described above, wherein the pan support is produced by means of 3D printing, in particular selective laser sintering.

This has the advantage that complex shapes of pan supports can be produced. For example, the channel can already be provided within the pan support during 3D printing. Moreover, it is possible to consider individual customer requirements that cannot be produced using conventional methods (for large quantities) when producing pan supports of this kind.

The embodiments and features described for the proposed pan support apply correspondingly to the gas hotplate, the gas cooker and the proposed method.

Further possible implementations of the invention also comprise combinations—not explicitly cited—of features or embodiments described above or below in respect of the exemplary embodiments. In this context, the person skilled in the art will also add individual aspects as improvements or enhancements to the respective basic form of the invention.

BRIEF DESCRIPTION OF THE DRAWINGS

Further advantageous embodiments and aspects of the invention form the subject matter of the subclaims and of the exemplary embodiments of the invention that are described below. The invention is also described in greater detail on the basis of preferred embodiments with reference to the attached figures.

FIG. 5 shows a section V from FIG. 3;

In the figures, elements that are identical or have the same function are denoted by the same reference characters unless otherwise stated.

DETAILED DESCRIPTION OF EXEMPLARY EMBODIMENTS OF THE PRESENT INVENTION

Figure 1:
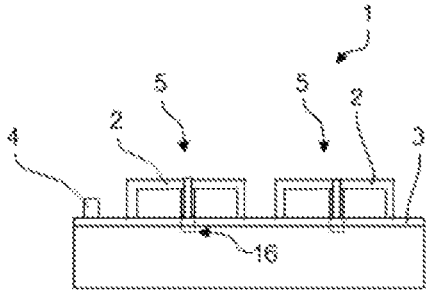
FIG. 1 shows a schematic side view of an embodiment of a household appliance.

FIG. 1 shows a schematic side view of an embodiment of a household appliance 1. The household appliance 1 is in particular a household cooking appliance, a gas cooker or a household cooker. The household appliance 1 can be a built-in appliance or a freestanding appliance.

The household appliance 1 comprises two pan supports 2. The pan supports 2 are in each case configured to hold a container for food to be cooked (not shown in FIG. 1) above a flame (not shown in FIG. 1). In other words, the pan support 2 serves as a support structure for a container for food to be cooked. The pan supports 2 can also be combined in one element to provide a one-piece pan support, which can support two containers for food to be cooked. The number of pan supports 2 is freely selectable. For example, four pan supports 2 can be provided. The pan supports 2 are arranged on a common cooktop plate 3. For example, the pan supports 2 can be fastened to the cooktop plate 3. The pan support or supports 2 are usually supported on the cooktop plate 3. For example, the pan support or supports 2 rest on the cooktop plate 3. Moreover, in each case a pipe section 16 projects in sections through the cooktop plate 3 (indicated by dotted lines).

The cooktop plate 3 can be a steel sheet, a glass plate or a glass ceramic plate, for example. Each pan support 2 is assigned a control element 4 for a gas valve or gas control valve, with the aid of which a combustion gas flow supplied to the respective pan support 2 can optionally be connected, disconnected and in particular steplessly switched on. Alternatively, the gas control valves can also be configured to regulate the combustion gas flow supplied to the respective pan support 2 in steps. This means that the gas control valves can be embodied as stepped gas control valves or what are known as step valves.

Each pan support 2 is assigned to a gas hotplate 5. For example, the pan supports 2 could be connected to, in particular made from one piece of material with, a base frame section (not shown in FIG. 1), which rests on the cooktop plate 3 and surrounds the gas hotplates 5. The household appliance 1 comprises two gas hotplates 5. Furthermore, the household appliance 1 could also comprise additional hotplates operated by means of electrical energy, such as an induction cooktop (not shown in FIG. 1). The household appliance 1 comprises for example three or four gas hotplates 5 of this kind.

Figure 2:
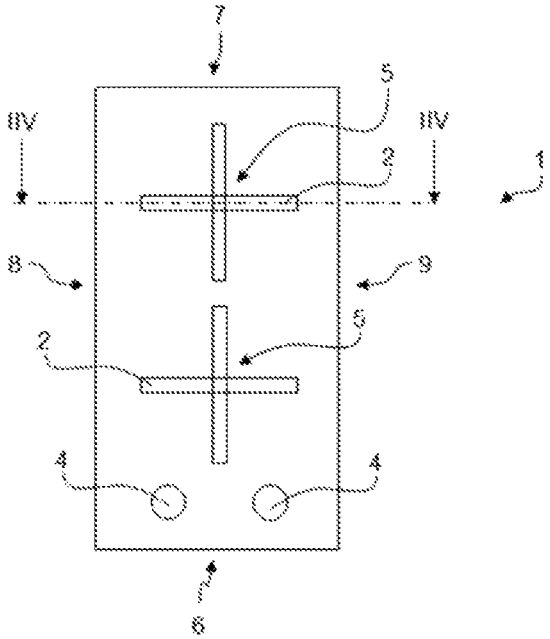
FIG. 2 shows a schematic top view of the household appliance according to FIG. 1.

FIG. 2 shows the household appliance 1 from FIG. 1 in a schematic top view. The household appliance 1 comprises a front side 6, on which the control elements 4 are arranged and which generally faces toward a user who is standing in front of the household appliance 1.

Furthermore, a rear side 7 of the household appliance 1 is provided opposite the front side 6, which rear side usually faces away from the user who is standing in front of the household appliance 1. The household appliance 1 also comprises a left side 8 and a right side 9, which is arranged opposite the left side 8.

Viewed from above, the pan supports 2 have a cross shape with four fingers. As can be seen from FIG. 2, no additional burner cover and no additional burner top part are present. The pan supports 5 have channels and gas outlet openings, so that the flames are produced directly on the fingers during operation. In the following figures, possible exemplary embodiments for pan supports are explained.

Figure 3:
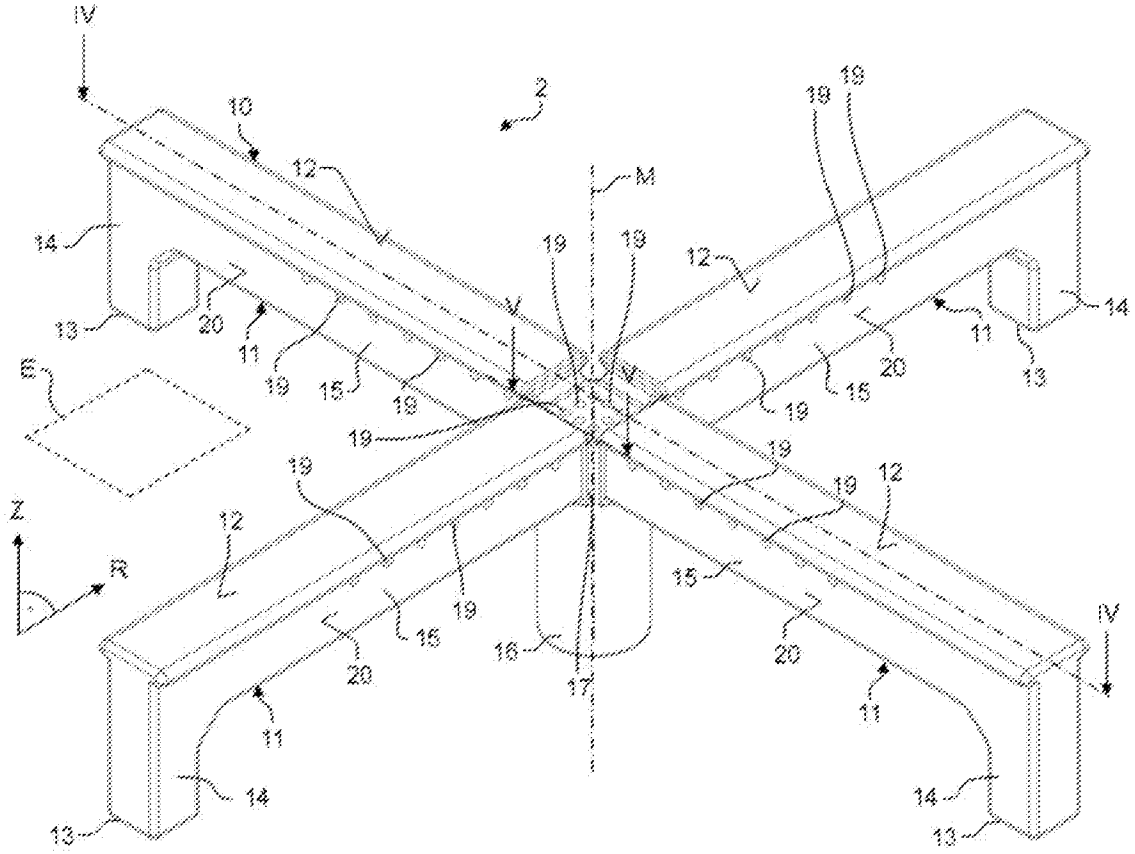
FIG. 3 shows a perspective view of a pan support from FIG. 2.

FIG. 3 shows a perspective view of a pan support 2, which can be used in the household appliance according to FIG. 2. The pan support 2 comprises a support structure 10 for a container for food to be cooked. The support structure 10 has four fingers 11, which are arranged radially about a central axis M of the pan support 2 at an angular distance of 90°. Here, two fingers 11 in each case lie mirror-symmetrically opposite one another. As shown in FIG. 2, viewed from the central axis M, one of the fingers 11 of the pan support 2 points toward the left side 8, one toward the right side 9, one toward the rear side 7 and one toward the front side 6 of the household appliance 1. Alternatively, the fingers 11 could also run diagonally to the sides 7, 8, 9, 10.

Each of the fingers 11 comprises a contact surface 12 for the container for food to be cooked and a support surface 13, which is provided to rest on the cooktop plate 3 and support the pan support 2 on the cooktop plate 3. Each of the fingers 11 extends from the support surface 13 initially in a vertical direction Z to form a column section 14, bends, and then extends in a radial direction R, which runs perpendicular to the vertical direction Z, to form a radial section 15 toward the central axis M. Here, the central axis M runs parallel to the vertical direction Z. As a result, the fingers 11 have an L shape. The radial section 15 is embodied as a T-shaped profile or T-shaped bar to enlarge the contact surface 12.

The pan support 15 further comprises a pipe section 16 for mixing primary air and combustion gas to form the flammable combustion gas and air mixture. The pipe section 16 is arranged centrally relative to the fingers 11 and extends in the vertical direction Z, so that the central axis M forms the longitudinal axis of the pipe section 16. The radial sections 15 are connected to the pipe section 16 on the outer peripheral surface 17 thereof. The support structure 10 and the pipe section 16 are embodied in particular in one piece or from a single piece of material.

The pipe section 16 is terminated in the vertical direction Z with a wall 18, which has a horizontal main extension plane E. The wall 18 extends parallel to the contact surfaces 12 and to the cooktop plate 3. Furthermore, the wall 18 is arranged below the contact surfaces 12. Moreover, the wall 18 comprises a plurality of gas outlet openings 19, which are open to the top. Viewed from above, the gas outlet openings 19 open to the top are arranged visibly between the four contact surfaces 12. The combustion gas and air mixture therefore exits directly upward.

Furthermore, at least one of the fingers 11 comprises the gas outlet openings 19. These are embodied on the radial section 15 and are arranged adjacent to one another along the radial direction R. The gas outlet openings 19 embodied on the radial section 15 are open to one side (in other words not to the top or to the bottom) of the radial section 15. As a result, the combustion gas and air mixture initially exits parallel to the contact surface 12. The gas outlet openings 19 embodied on the radial section 15 are accordingly arranged on lateral surfaces 20 of the radial section 15, which are embodied perpendicular to the contact surface 12. Furthermore, gas outlet openings 19 can be embodied on two opposite lateral surfaces 20 of a radial section 15.

Figure 4:
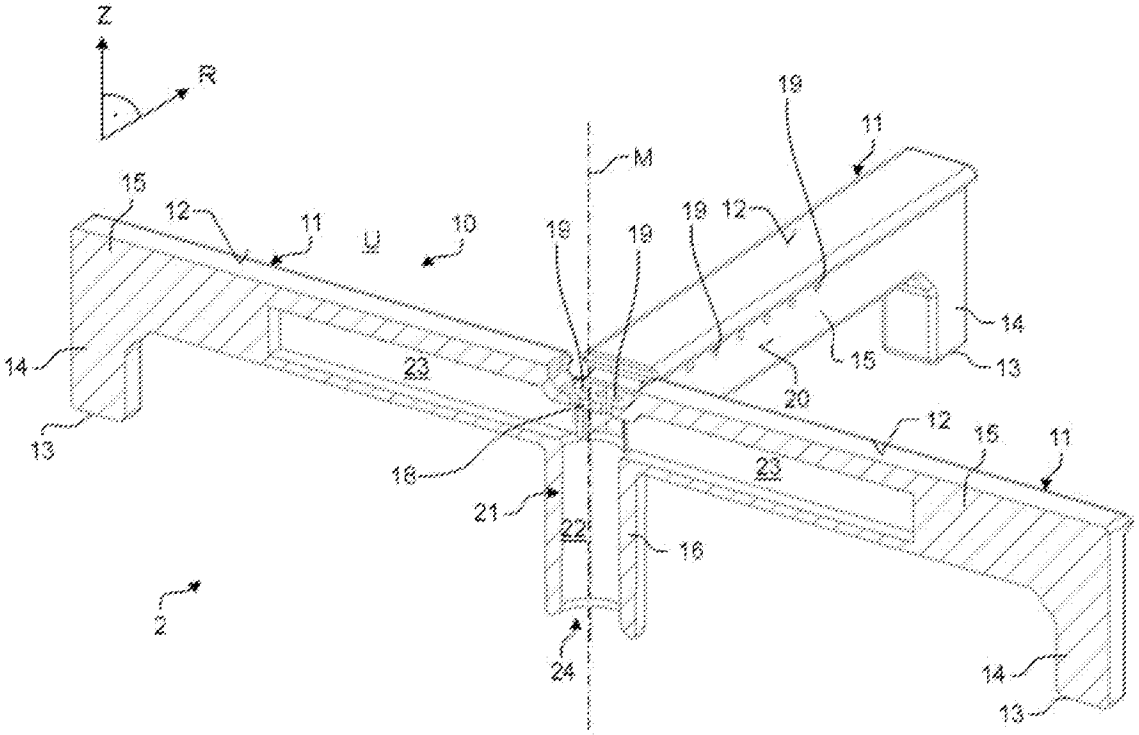
FIG. 4 shows a section IV from FIG. 3.

FIG. 4 shows a section IV from FIG. 3, which cuts the pan support 2 into two equal-sized halves and runs longitudinally through two opposite fingers 11 and the pipe section 16. The pan support 2 has a channel 21 for the combustion gas and air mixture, which leads to the gas outlet openings 19. The channel 21 has a channel section 22 running from top to bottom, which is enclosed by the pipe section 16 and begins at a lower opening 24 of the pipe section 16, which is open to the bottom. The channel section 22 is column-shaped and has a round outer contour. The pipe section 16 can for example be designated, in conjunction with a nozzle for the combustion gas (not shown), as a venturi nozzle.

Furthermore, the channel section 22 is delimited to the top by the wall 18 and opens into channel branches 23, which are arranged within the radial sections 15. The gas outlet openings 19 create accesses from an environment U, which surrounds the pan support 2, and the channel section 22 and channel branches 23. This enables the combustion gas and air mixture to reach the environment U, in which it can burn. A respective channel branch 23 extends in the radial direction R and ends within the respective radial section 15.

The pan support 2 is produced for example by means of 3D printing, in particular selective laser sintering. Here, it is possible to produce the fingers 11 and/or the pipe section 16 and/or the wall 18 as a component made from a single piece of material, in particular with channel section 22 provided therein and/or channel branches 23 provided therein and/or gas outlet openings 19 provided therein. For example, the pan support 2 is produced from a metal or the pan support has a metal.

FIG. 5 shows a section V from FIG. 3, which runs horizontally through the radial section 15 of one of the fingers 11. Here, FIG. 5 shows the channel branch 23 as a cross-section. The channel branch 23 has a rectangular cross-section geometry and is formed as a cuboid volume. A height D1 of the finger 11 between the support surface 13 and the contact surface 12 is smaller than a distance D2 between the lower opening 24 of the pipe section 16 and the contact surface 12, wherein the difference between the distance D2 and the height D1 is in particular greater than a thickness D3 (see FIG. 7) of the cooktop plate 3.

Figure 6:
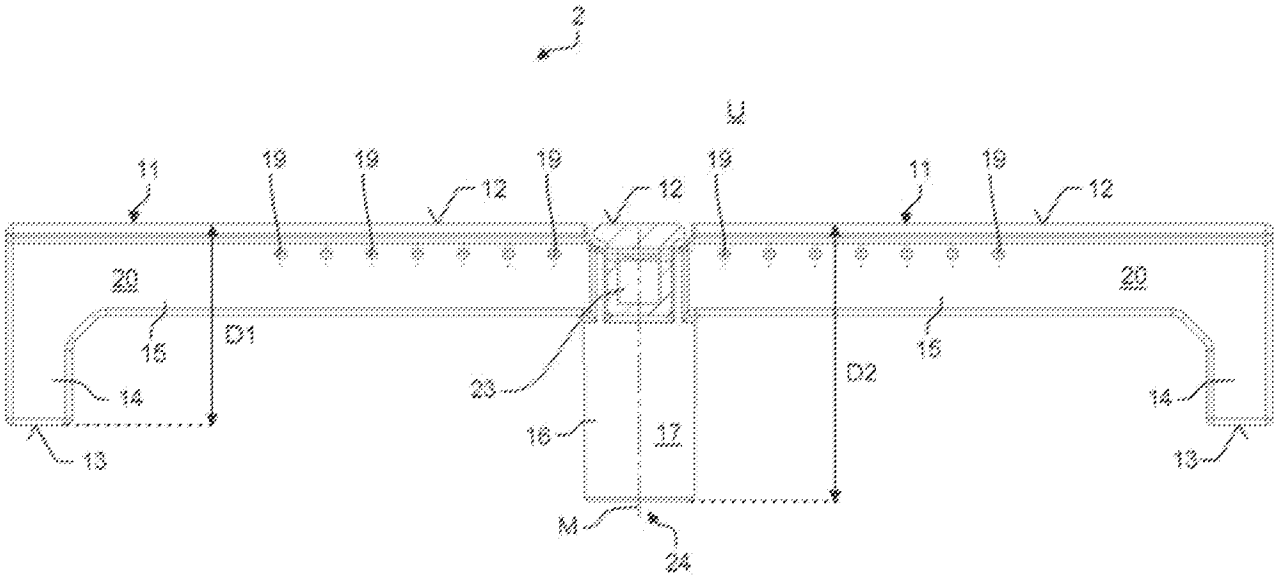
FIG. 6 shows a further section of the pan support according to FIG. 3.
Figure 6:
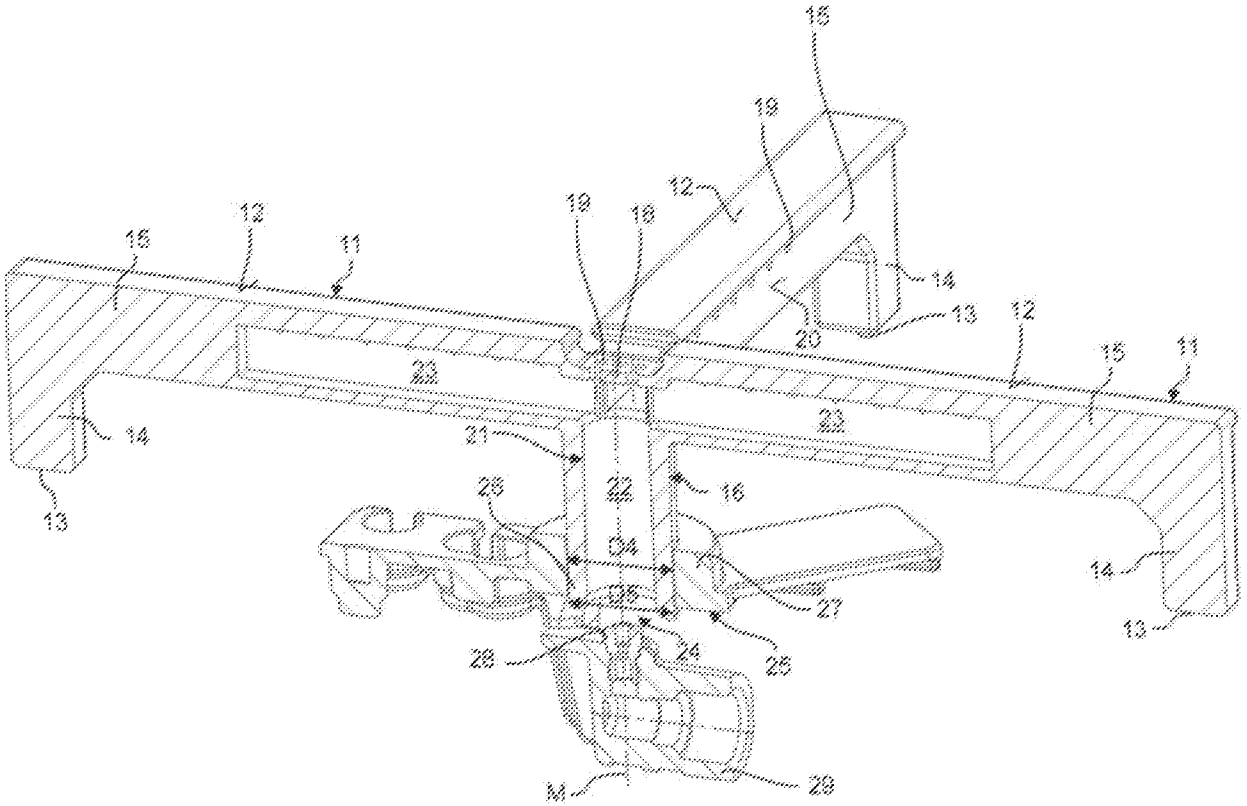

FIG. 6 shows a further sectional view of the pan support 2 according to FIG. 3. This differs from FIG. 4 in that a supporting molding 25 is provided for a lower end 26 of the pipe section 16. The supporting molding 25 has a ring section 27 in the shape of a circular ring, into which the lower end 26 of the pipe section 16 can be inserted. Here, an inner diameter D4 of the ring section 27 corresponds substantially to an outer diameter D5 of the lower end 26 of the pipe section 16. The supporting molding 25 is positioned at an opening 29 (not shown in FIG. 6) of the cooktop plate 3 and is fastened thereto.

In addition, a gas nozzle 28 open to the top is provided below the ring section 27 and the pipe section 16. The gas nozzle 28 has a fluid connection with a gas supply line 29 and is configured to provide the combustion gas. To this end, the gas nozzle 28 is arranged below the opening 24 so that the combustion gas can rise directly into the pipe section 16. In addition, primary air is provided at the opening 24 so that a flammable combustion gas and air mixture can be formed. The channel section 22 can be designated for example as a corresponding mixing chamber.

Alternatively, the opening 24 could be open to one side instead of to the bottom so that the combustion gas and air mixture can flow from the side into the pipe section 16.

Figure 7:
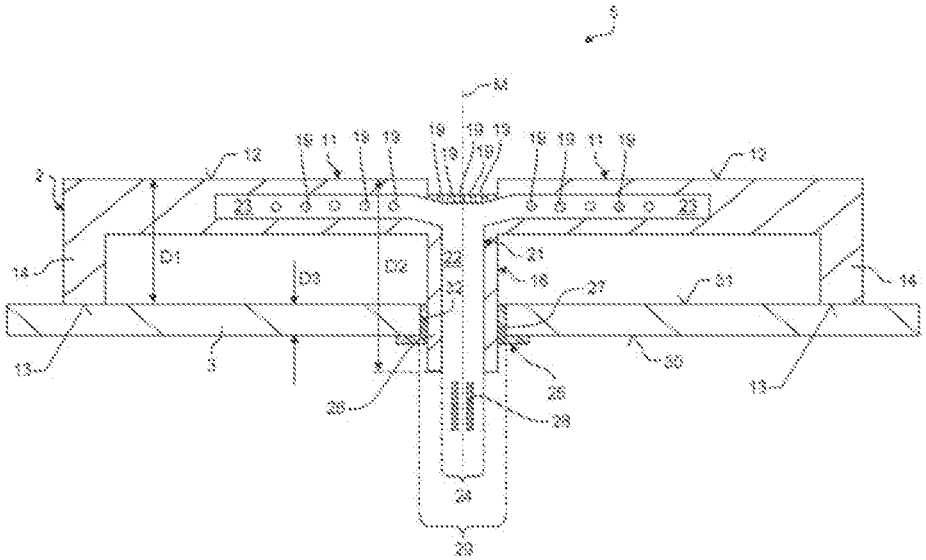
FIG. 7 shows a section IIV from FIG. 2.

FIG. 7 shows a section IIV from FIG. 2, wherein the gas hotplate 5 is represented in a schematic cross-section view. The gas hotplate 5 comprises the cooktop plate 3, the pan support 2, the supporting molding 25 and the gas nozzle 28. In the cooktop plate 3, the opening 29, which is embodied as a through-opening, is provided for the ring section 27 of the supporting molding 25. The lower end 26 of the pipe section 16 is received by the ring section 27, so that part of the pipe section 16 projects downwardly from an underside 30 of the cooktop plate 3. Furthermore, the support surfaces 13 rest on a top side 31 of the cooktop plate 3.

The channel 21 of the pan support 2 thus extends at least partially through the opening 29. Alternatively, there may be no supporting molding 25 provided, so that the end 26 of the pipe section 16 is received directly by the opening 29 and is in contact with an inner side 32 of the same. As a further alternative, the pipe section 16 could have a fluid connection with the opening 29. For example, the pipe section 16 could project on the top side 31 of the cooktop plate 3, so that the opening 24 of the pipe section 16 is provided flush over the opening 29 of the cooktop plate 3.

As can be seen from FIG. 7, this produces the advantage that, when the pan support 2 is removed, the cooktop plate 3 has no protrusions (e.g. gas burner upper part or burner lid), enabling for example the cooktop plate 3 to be cleaned more easily.

Furthermore, positioning aids could be provided on the pan support 2 in order to facilitate an attachment of the pan support 2 onto the cooktop plate 3. Such a positioning aid can be embodied for example as a protrusion, in particular a pipe section, which engages into an indentation of the cooktop plate 3. This ensures that rotation is prevented.

Alternatively or additionally, the channel 21 could also be provided in the column sections 14, wherein the column sections 14 could extend through openings (not shown in FIG. 7) of the cooktop plate 3 or have a fluid connection therewith. The channel 21 could accordingly lead from the column sections 14 into the channel branches 23.

Although the present invention has been described with reference to exemplary embodiments, it can be modified in numerous different ways. The pan supports can have different shapes, for example can describe arcs or have parallel fingers. It is also conceivable for a pan support to be assigned to several gas hotplates and to embody separate channels. A pan support can be joined together from several elements. An injection molding method, for example, can also be used for production.

The invention claimed is:

1. A pan support for a gas cooker, said pan support comprising a support structure for a container for food to be cooked, said support structure having a contact surface for the container and a channel for a flammable combustion gas and air mixture, which channel leads to gas outlet openings, and a support surface configured to contact a cooktop plate of the gas cooker, wherein the support structure includes at least two fingers arranged radially about a central axis of the pan support, a first finger of the at least two fingers comprises a main body and the support surface, the channel is inside main body of the first finger, at least one of the gas outlet openings is in the main body of the first finger, and the main body of the first finger is configured to not contact the cooktop plate.

2. The pan support of claim 1, wherein the support structure is formed in one piece or made from a single piece of material.

3. The pan support of claim 1, further comprising a pipe section for mixing primary air and combustion gas to form the flammable combustion gas and air mixture, said support structure and said pipe section being made in one piece or made from a single piece of material.

4. The pan support of claim 1, wherein the support structure includes three, four, five or six fingers arranged radially about a central axis of the pan support.

5. The pan support of claim 1, wherein the first finger has an L shaped configuration, and the support surface is located on an end of one leg of the L shape.

6. The pan support of claim 1, wherein the gas outlet openings are arranged adjacent to one another along a first extension direction of the main body of the first finger.

7. The pan support of claim 1, wherein the gas outlet openings are open to one side of the first finger.

8. The pan support of claim 1, further comprising a upward facing gas outlet opening, wherein the upward facing gas outlet opening is configured to be open on a side of the support structure opposite to the support surface.

9. The pan support of claim 8, wherein the at least two fingers further comprises a second finger, and the at least one of the gas outlet openings is formed between a contact surface of the first finger and a contact surface of the second finger.

10. A gas hotplate, comprising a pan support, said pan support comprising a support structure for a container for food to be cooked, said support structure having a contact surface for the container and a channel for a flammable combustion gas and air mixture, which channel leads to gas outlet openings, and a support surface configured to contact a cooktop plate of the gas hotplate, wherein the support structure includes at least two fingers arranged radially about a central axis of the pan support, a first finger of the at least two fingers comprises a main body and the support surface, the channel is inside main body of the first finger, at least one of the gas outlet openings is in the main body of the first finger, and the main body of the first finger is configured to not contact the cooktop plate.

11. The gas hotplate of claim 10, further comprising:

a cooktop plate having an opening; and a gas nozzle arranged below the cooktop plate for providing combustion gas, said pan support having a channel extending at least partially through the opening or being in fluid connection with the opening, said channel guiding a combustion gas and air mixture, comprising primary air and combustion gas, to the gas outlet openings.

12. The gas hotplate of claim 10, further comprising:

a cooktop plate; and a pipe section for mixing primary air and combustion gas to form a flammable combustion gas and air mixture, said pipe section embodied in one piece or made from a single piece of material with the support structure of the pan support, said pipe section configured to pierce through the cooktop plate in a downward direction.

13. The gas hotplate of claim 10, further comprising a cooktop plate, said support structure of the pan support having two, three, four, five or six fingers, each of the fingers comprising a one of said contact surface and being supported on the cooktop plate.

14. The gas hotplate of claim 10, wherein the first finger has an L shaped configuration, and the support surface is located on an end of one leg of the L shape.

15. The gas hotplate of claim 10, wherein the gas outlet openings are arranged adjacent to one another along a first extension direction of the main body of the first finger.

16. The gas hotplate of claim 10, wherein the gas outlet openings are open to one side of the first finger.

17. The gas hotplate of claim 10, further comprising a upward facing gas outlet opening, wherein the upward facing gas outlet opening is configured to be open on a side of the support structure opposite to the support surface.

18. The gas hotplate of claim 10, wherein the at least two fingers further comprises a second finger, and the at least one of the gas outlet openings is formed between a contact surface of the first finger and a contact surface of the second finger.

19. The gas hotplate of claim 18, further comprising a upward facing gas outlet opening, wherein the upward facing gas outlet opening is configured to be open on a side of the support structure opposite to the support surface, wherein the second finger comprises a second channel, the second channel being inside a main body of the second finger.

20. The pan support of claim 9, further comprising a upward facing gas outlet opening, wherein the upward facing gas outlet opening is configured to be open on a side of the support structure opposite to the support surface, wherein the second finger comprises a second channel, the second channel being inside a main body of the second finger.

* * * * *